US010835902B2

(12) United States Patent
Gomes Cavaco

(10) Patent No.: US 10,835,902 B2
(45) Date of Patent: Nov. 17, 2020

(54) SUPPORT HOUSING FOR SAMPLING CONES FOR A PIPETTING SYSTEM

(71) Applicant: GILSON SAS, Villiers-le-Bel (FR)

(72) Inventor: Philippe Gomes Cavaco, Samognat (FR)

(73) Assignee: GILSON SAS, Villiers-le-Bel (FR)

( * ) Notice: Subject to any disclaimer, the term of this patent is extended or adjusted under 35 U.S.C. 154(b) by 241 days.

(21) Appl. No.: 16/099,092

(22) PCT Filed: May 10, 2017

(86) PCT No.: PCT/EP2017/061121

§ 371 (c)(1),
(2) Date: Nov. 5, 2018

(87) PCT Pub. No.: WO2017/194575

PCT Pub. Date: Nov. 16, 2017

(65) Prior Publication Data

US 2019/0201908 A1 Jul. 4, 2019

(30) Foreign Application Priority Data

May 12, 2016 (FR) ..... 16 54249

(51) Int. Cl.
*B01L 9/00* (2006.01)

(52) U.S. Cl.
CPC ..... *B01L 9/543* (2013.01); *B01L 2200/025* (2013.01); *B01L 2300/0858* (2013.01)

(58) Field of Classification Search
CPC ..... B01L 9/543; B01L 2200/025; B01L 2300/0858; B01L 2300/0893
See application file for complete search history.

(56) References Cited

U.S. PATENT DOCUMENTS 2,868,430 A * 1/1959 Hamilton ..... B65D 5/4295 206/510
2005/0236346 A1 10/2005 Whitney
(Continued)

FOREIGN PATENT DOCUMENTS

DE 92 16 674 U1 3/1993

OTHER PUBLICATIONS

International Search Report for International Application No. PCT/EP2017/061121 dated Jun. 6, 2017.
(Continued)

*Primary Examiner* — Jennifer Wecker
*Assistant Examiner* — Sophia Y Lyle
(74) *Attorney, Agent, or Firm* — Pearne & Gordon LLP

(57) ABSTRACT

The invention concerns a support housing for sampling cones for a pipetting system, the housing being intended to be stacked with other identical housings in a stacking direction, and comprising: a support provided with openings for housing the sampling cones; first and second opposing side walls traversed by a virtual median plane. According to the invention, each of the first and second opposing side walls is equipped with a female coupling member and a male coupling member arranged substantially symmetrically to either side of the plane, the two female coupling members of the first and second opposing side walls being arranged to a same side of the plane and the two male coupling members of the first and second opposing side walls being arranged to the other side of the plane.

10 Claims, 7 Drawing Sheets

(56) References Cited

U.S. PATENT DOCUMENTS

| | | | | |
|---|---|---|---|---|
| 2006/0045815 | A1 | 3/2006 | Hovatter | |
| 2011/0300620 | A1* | 12/2011 | Belz | B01L 3/50853 435/287.2 |
| 2012/0257953 | A1 | 10/2012 | Williams et al. | |
| 2016/0101422 | A1* | 4/2016 | Bucher | B01L 9/543 422/564 |

OTHER PUBLICATIONS

Preliminary French Search Report for French Patent Application No. 1654249 dated Jan. 6, 2017.

* cited by examiner

SUPPORT HOUSING FOR SAMPLING CONES FOR A PIPETTING SYSTEM

TECHNICAL FIELD

The invention relates to the field of casings for supporting sampling cones intended to pipetting systems such as robots, automatons, or sampling pipettes. These casings are conventionally called "racks".

STATE OF PRIOR ART

Such casings have to carry sampling cones before they are sleeved to the pipetting system, for example to the tips of a pipetting robot or even to the tips of a multichannel, manual or motor sampling pipette. The pitch between the ports for housing the sampling cones is such that it matches the pitch of the tips of the pipetting system, to enable these tips to be readily inserted into the cones.

Usually, casings equipped with cones are stacked on top of each other. Thus, when a casing has been fully emptied from its cones following repeated pipetting actions, the emptied casing is removed from the stack and leaves room for a lower casing filled with other cones.

In the case of manual operations made using sampling pipettes, the stacking of casings is caused to be handled by the operator, such that it is usually preferable to provide mating means between the superimposed casings. In this case, switching from one casing to another by the operator is made by actuating the mating means to unlock them, and thus allow extraction of one of both casings.

For automated pipetting operations using a robot or automaton, these mating means cause complexification in the pipetting method, that is why the casings are generally simply laid on top of each other in the stack, without mutual retaining means.

However, the situation described above results in manufacturing casings having different designs depending on whether they are intended to a manual or automated use. That complexifies the method of producing stacks of casings, because after manufacturing the same, a robot grips each casing and then identifies it in order to determine whether it should be oriented towards a stack of casings retained to each other, or to a stack of casings simply laid on top of each other.

From the user's point of view, an analogous drawback remains because he/she has to have available casings of different types, depending on the pipetting system being implemented. That complexifies the management of these supports of consumables.

DISCLOSURE OF THE INVENTION

Therefore, the purpose of the invention is to overcome at least partially the above identified drawback, relating to embodiments of prior art.

To that end, one object of the invention is a casing for supporting sampling cones for a pipetting system, the casing being intended to be stacked with other identical casings along a stacking direction, and comprising:

- a support provided with ports for housing the sampling cones; and
- first and second opposite flanks integral with the support and through which a median imaginary plane integrating the stacking direction passes.

According to the invention, each of the first and second opposite flanks is equipped with a mating female member as well as a mating male member arranged substantially symmetrically on either side of said median imaginary plane, both mating female members of the first and second opposite flanks being arranged on a same side of the median imaginary plane and both mating male members of the first and second opposite flanks being arranged on the other side of the median imaginary plane, and said mating male and female members are designed such that when two identical supporting casings are stacked along the stacking direction with an upper casing and a lower casing both having their male members on a same side of the median imaginary plane, the upper casing assumes a laid position in which it is not retained by the lower casing in the stacking direction, and also designed such that when the upper casing and the lower casing have their mating male members respectively on either side of the median imaginary plane, the upper casing assumes a retained position in which its two mating male members respectively cooperate with both mating female members of the lower casing.

Thus, the invention provides an original solution enabling one and a single design of casings to be preserved, while being able to place them in a laid position or a retained position, depending on the use contemplated. This feature enables the manufacture of casings to be facilitated and simplifies the management of the same by users. In particular, in the production line of casings, it is no longer necessary to identify the type of casing which is manufactured, nor to choose among two distinct stacking ways. As a result, there is advantageously a large simplification of production operations, and that generates substantial gains in terms of the production times and programming development, etc.

Additionally, the invention has at least any of the following optional technical characteristics, taken alone or in combination.

Each mating male member comprises a tab pivotably mounted to its associated flank through a pivot joint with an axis substantially orthogonal to the stacking direction, the tab having on either side of the pivot joint a gripping portion, as well as an anchoring portion terminating with a notch.

Said pivot joint is made of two elastically torsionally deformable beads of material, both beads of material being aligned with each other along the axis of the pivot joint.

The gripping portion upwardly projects beyond its associated flank, and said notch is arranged substantially at a bottom end of this flank.

The female member has in an upper part thereof a ramp enabling, during a relative movement of the upper casing towards the lower casing in the stacking direction, its associated male member to be pivoted about said pivot joint by moving the notch along the ramp, before the notch is automatically inserted in the female member after this notch has left said ramp.

In this case, said automatic insertion of the notch in the mating female member is made by pivoting the mating male member caused by a release of energy previously stored by the pivot joint, during the movement of the notch along the ramp.

Alternatively, this insertion can be made not automatically, but manually by depressing the gripping portions of the tabs, and then by releasing them.

Each mating female member is arranged substantially at a top end of its associated flank, in the proximity of a junction with the support of sampling cones.

The support has 96 ports for housing the sampling cones. Of course, a different number of ports can be provided, without departing from the scope of the invention.

Another object of the invention is an assembly comprising several identical casings as described above, said casings being stacked along the stacking direction, in the laid position or in the retained position.

Finally, the assembly preferably comprises a hollow bottom arranged at the base of the stack of casings, said hollow bottom comprising female members for mating with the casing which is the lowermost in the stack.

Further advantages and characteristics of the invention will appear in the detailed non-limiting description below.

BRIEF DESCRIPTION OF THE DRAWINGS

This description will be made with regard to the appended drawings in which.

DETAILED DESCRIPTION OF PREFERRED EMBODIMENTS

Figure 1:
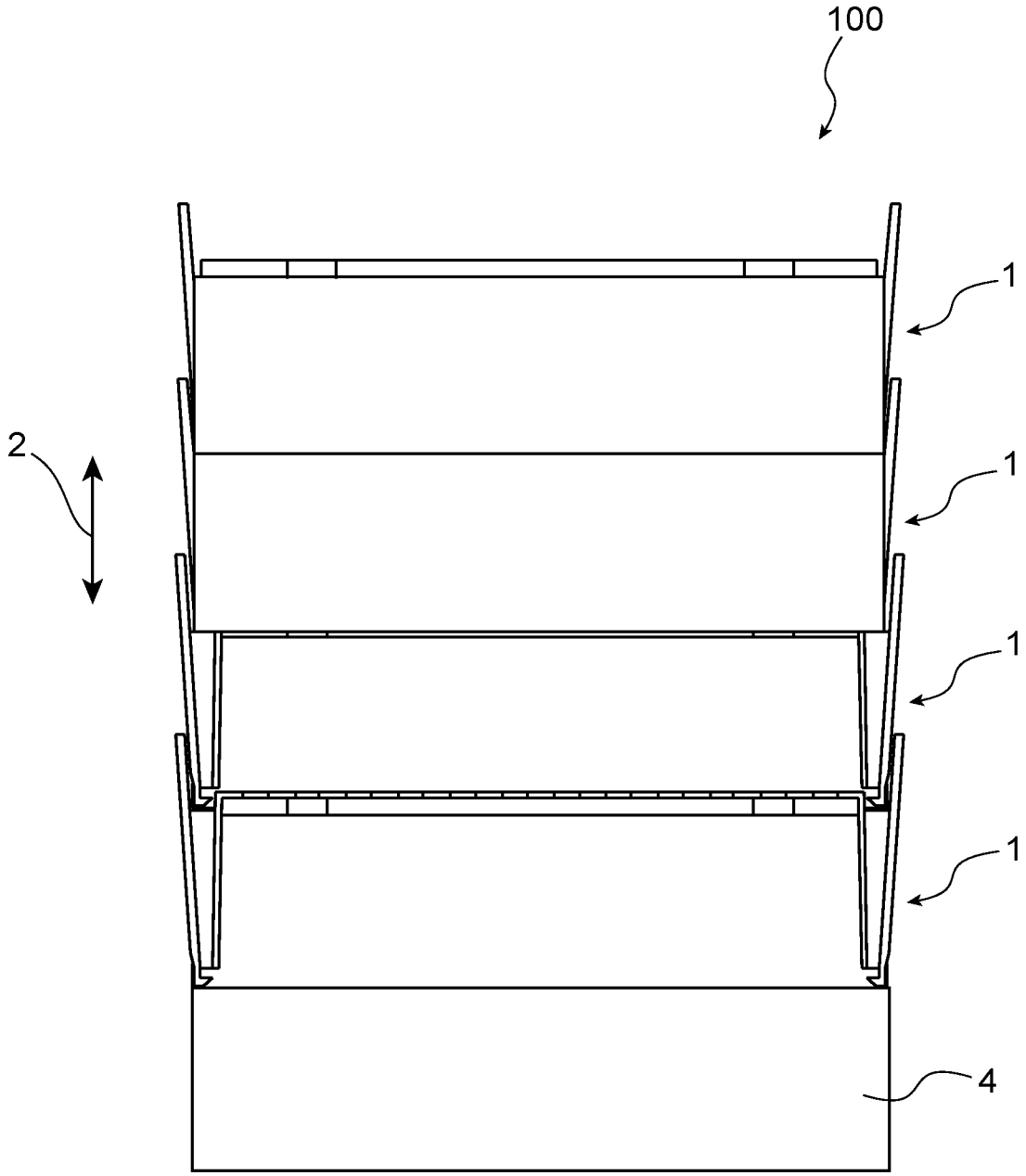
FIG. 1 represents a partially cross-section front view of a stacked assembly of casings for supporting sampling cones, according to a preferred embodiment of the invention.

In reference to FIG. 1, an assembly 100 according to a preferred embodiment of the invention is represented, this assembly corresponding to a stack of casings for supporting sampling cones, for a pipetting system.

The casings 1 are superimposed with each other along a stacking direction 2, here corresponding to the vertical direction. According to a specificity of the invention which will be detailed hereinafter, the casings 1 of the stack can be either simply laid on each other, or retained to each other along the stacking direction 2.

The casings 1 are for containing sampling cones (not represented), also called consumables. Thus, when the assembly of cones are removed from the casing which is the uppermost in the stack, the same casing is extracted from the stack and gives access to the directly consecutive cones carried by the casing. This process is reiterated up to the lowermost casing, carried by a hollow bottom 4 arranged at the base of the stack.

Figure 2:
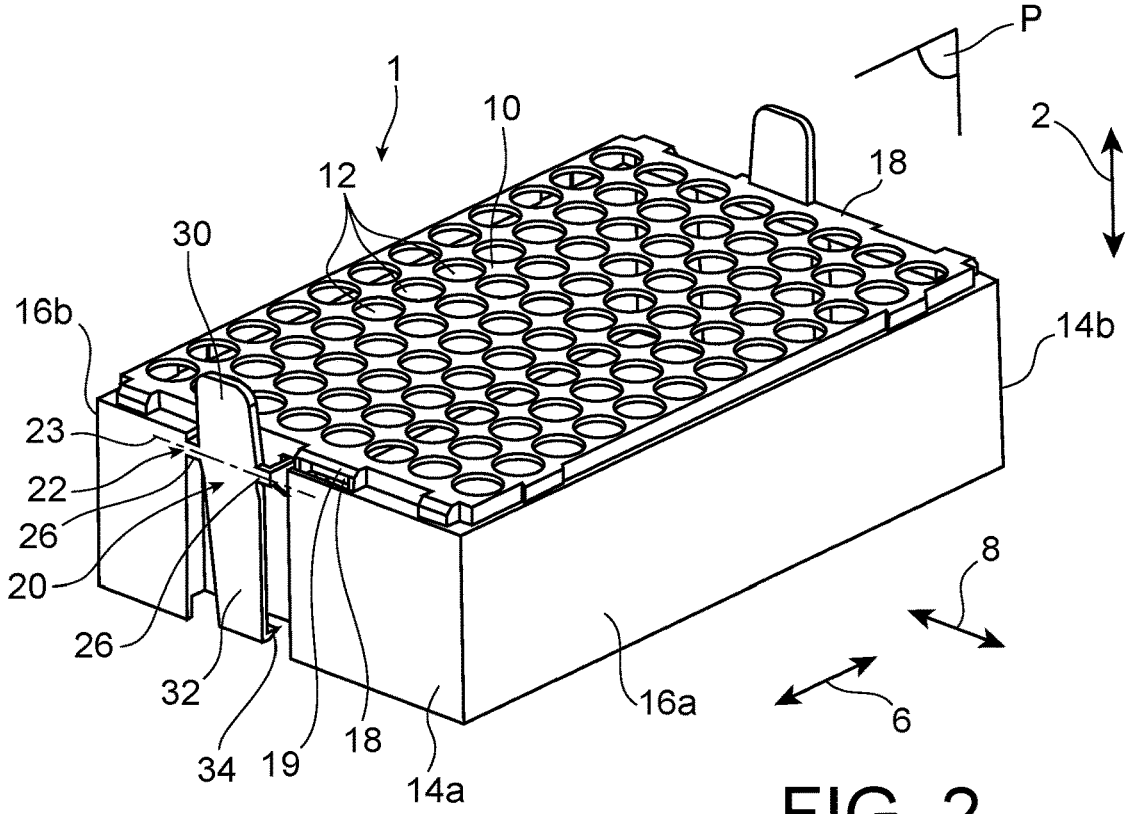
FIG. 2 represents a perspective view of one of the casings of the stack shown in the previous FIG.
Figure 3:
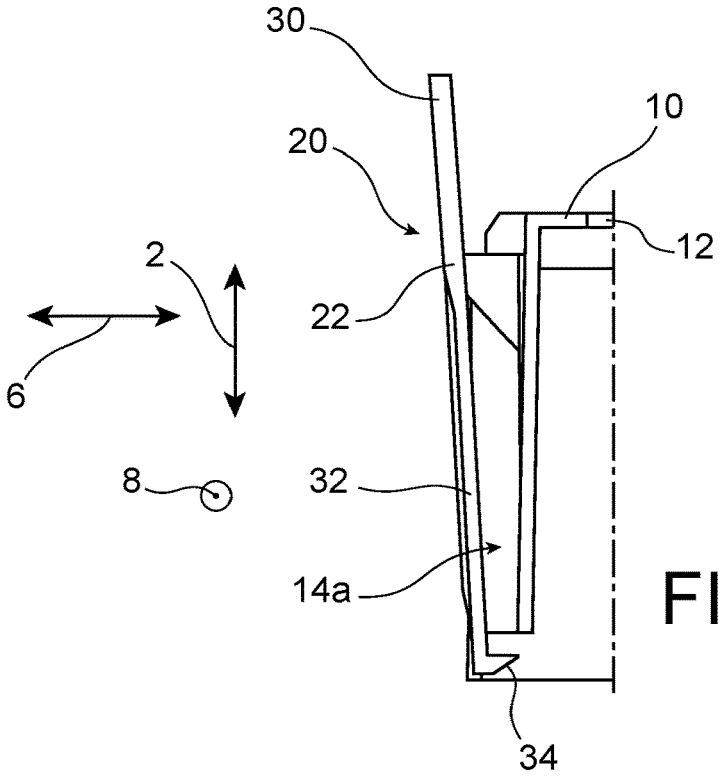
FIG. 3 is a longitudinal cross-section view of a part of the casing shown in the previous FIG., passing through one of its mating male members.
Figure 4:
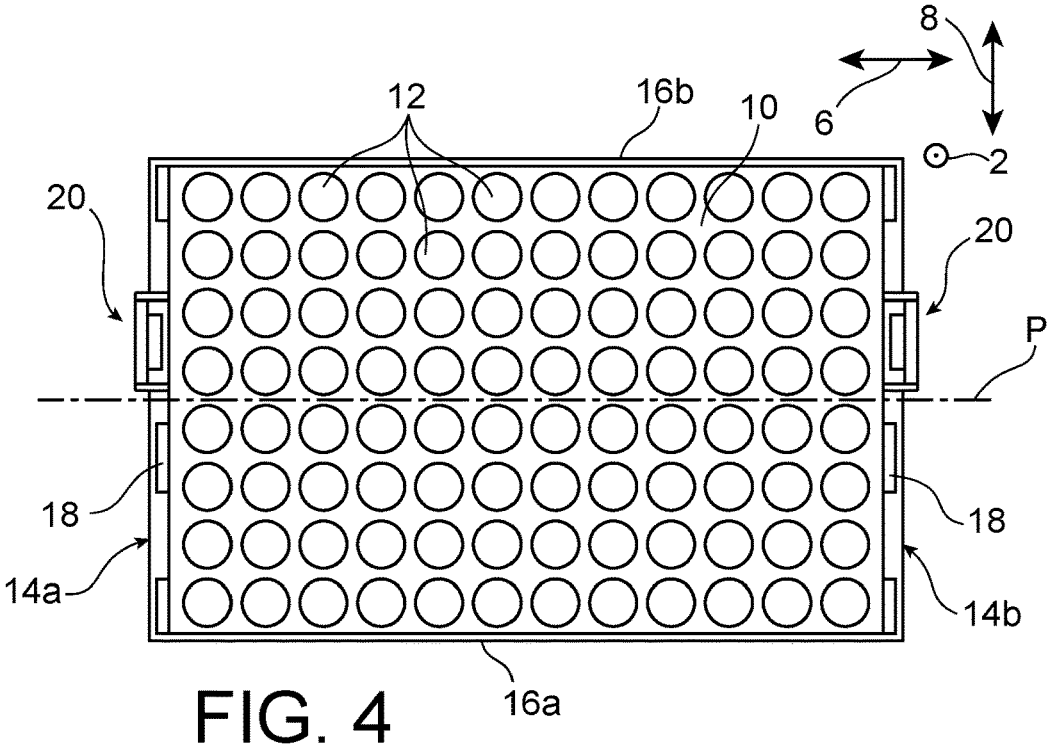
FIG. 4 is a top view of the casing shown in FIGS. 2 and 3.

FIGS. 2 to 4 illustrate one of the casings 1 of the stack, which all have an identical design.

The casing 1, made as a single piece, has a generally parallelepipedal, and hollow shape comprising an upper wall which provides support for the consumables. This support 10 is arranged in a plane orthogonal to the stacking direction 1, and equipped with ports 12 for housing the sampling cones. Here, there are for example 96 ports 12 distributed in rows and columns, much like a matrix. The pitch between the ports 12 is provided to match the pitch of the tips of the pipetting system, to enable these tips to be readily inserted into the cones.

The casing 1 extends lengthwise along a longitudinal direction 6 and widthwise along a transverse direction 8, the three directions 2, 6, 8 being orthogonal to each other.

At the periphery of the support 10, the casing 1 comprises four flanks, namely first and second opposite flanks 14*a*, 14*b*, which are integral with the support 10 and through which a median imaginary plane P integrating the stacking direction 2 passes. Consequently, each of both these opposite flanks 14*a*, 14*b* along the direction 6 extends in a transverse plane, defined by both directions 2 and 8. Two other opposite flanks 16*a*, 16*b* along the direction 8 complete the perimeter of the support 10, by each extending in a longitudinal plane defined by both directions 2 and 6.

One of the features of the invention resides in the design of the mating means between the successive casings, wherein these means can be active or passive depending on the relative orientation of the casings in the stack, as will be explained hereinafter.

Each of the first and second opposite flanks 14*a*, 14*b* is equipped with a mating female member 18, in the form of a single slot opening outwardly in the direction 6. The female member 18 is arranged substantially at a top end of the flank on which it is located, in the proximity of a junction with the support 10. The slot is delimited in an upper part thereof by a ramp 19 which extends outwardly in the direction 6, moving downwards.

Each of the first and second opposite flanks 14*a*, 14*b* is also equipped with a mating male member 20, taking the form of a tab pivotably mounted to its associated flank, through a pivot joint 22. The pivot joint 22 has a pivoting axis 23 substantially orthogonal to the stacking direction 2, and parallel to the transverse direction 8. It is made by two elastically torsionally deformable beads of material 26 along the axis 23, and aligned with each other along the same axis.

The tab 20 has a height higher than that of the casing 1. On either side of the pivot joint 22, it comprises on the one hand a gripping portion 30 extending upwardly by projecting beyond its associated flank and beyond the support 10, and on the other hand an anchoring portion 32 terminating with a notch 34 substantially arranged at a bottom end of the flank.

The notch 34 projects towards inside the casing 1, along the direction 6 in opposition to the tab 20 which extends generally in the stacking direction 2.

As is more visible in FIG. 4, on each flank 14*a*, 14*b*, the female member 18 and the male member 20 are substantially symmetrically arranged on either side of the median imaginary plane P. In addition, both mating female members 18 of the first and second opposite flanks 14*a*, 14*b* are arranged on a same side of the median imaginary plane P, and both mating male members 20 of the same flanks are arranged on the other side of the median imaginary plane P.

Figure 5:
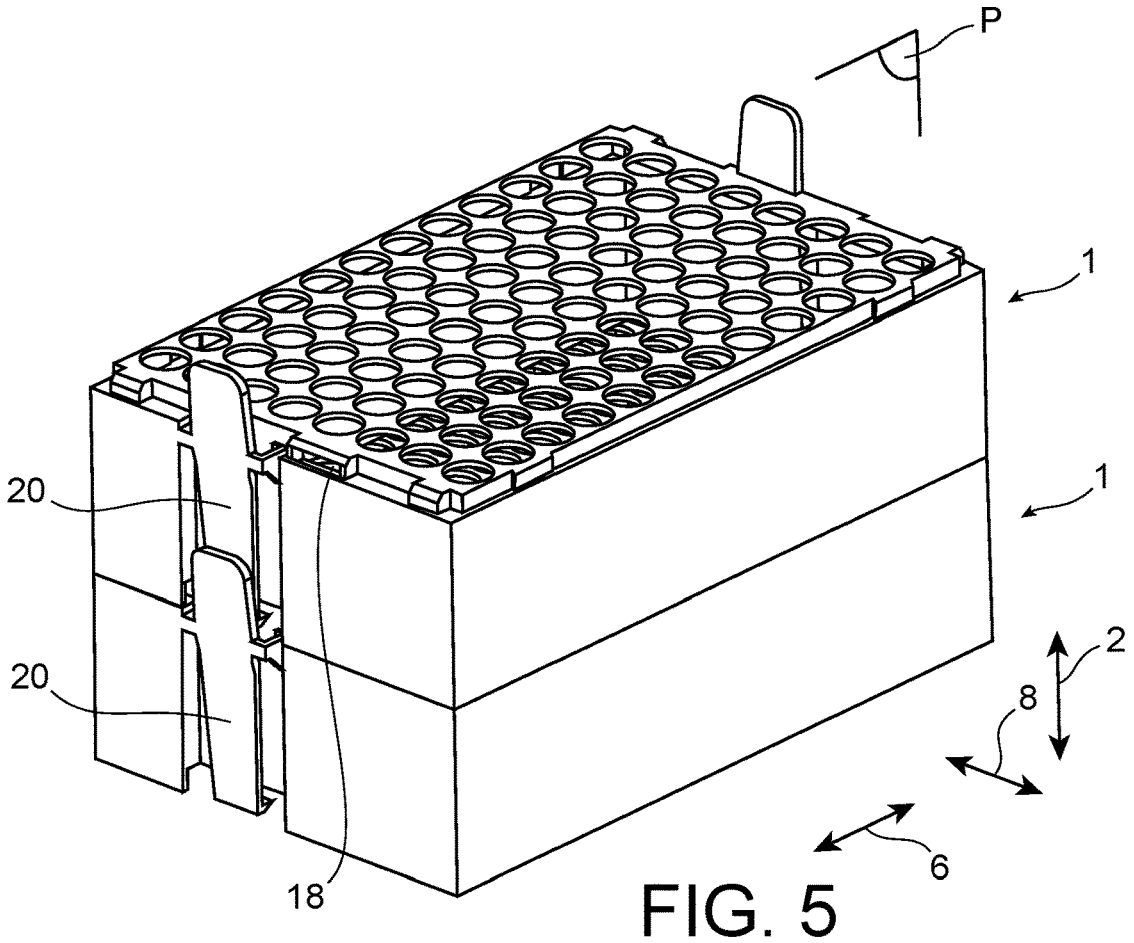
FIG. 5 is a perspective view of a stack of two casings in a laid position.
Figure 6:
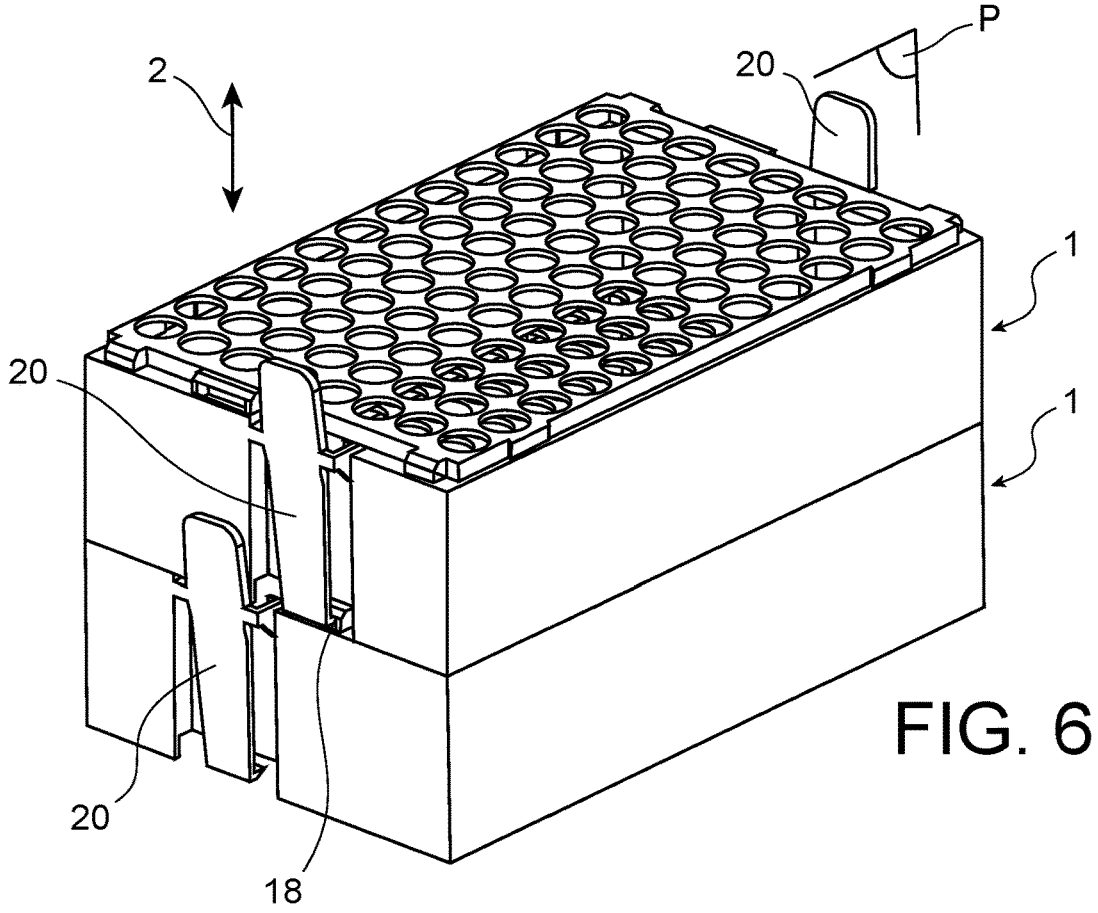
FIG. 6 is a perspective view of a stack of two casings in a retained position.
Figure 5A:
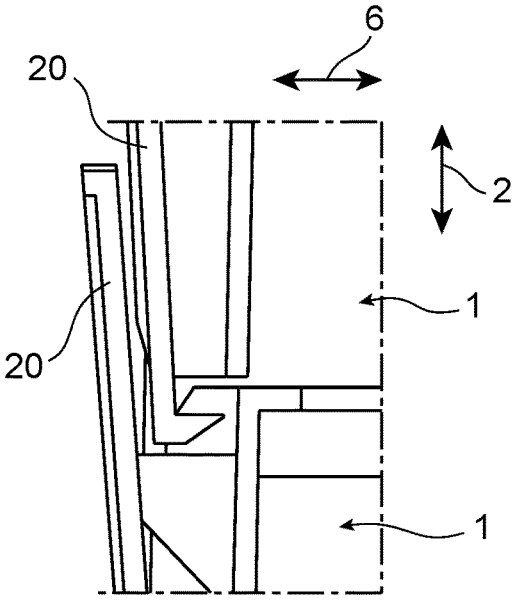
FIG. 5*a* is a longitudinal cross-section view of a part of the stack shown in FIG. 5, passing through the mating male members.

In this manner, it is possible to stack two casings 1 two different ways, which are represented in FIGS. 5 and 6. In the stack of FIG. 5, the upper casing 1 assumes a position laid onto the lower casing, without being retained along the stacking direction 2. Indeed, in this case, the male members 20 of both casings are located on the same side of the median imaginary plane P, and are thus covering each other two by two along direction 6, as is also visible in FIG. 5*a*.

In this simply laid position of the upper casing 1 onto the lower casing 1, the male members 20 thus do not cooperate with the female members 18, which are located on the other side of the median imaginary plane P.

This stacking type, in which the casings 1 assume a same angular position relative to a stacking central axis, is preferentially retained in the case of the use of the assembly 100 by robots/automatons, enabling pipetting operations to be automatically made.

Figure 6A:
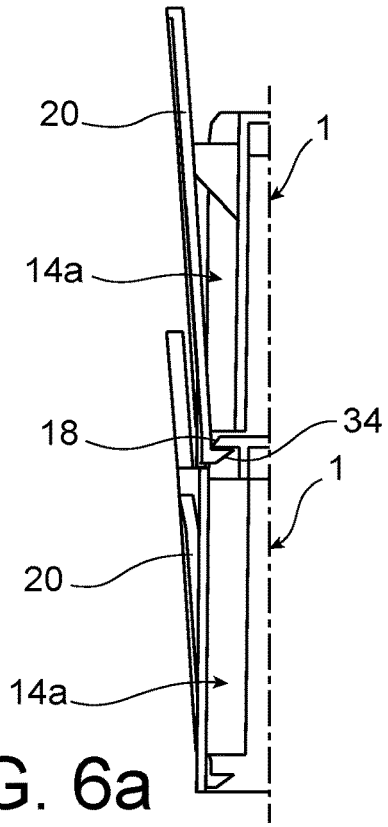
FIG. 6*a* is a longitudinal cross-section view of a part of the stack shown in FIG. 6, passing through the mating male and female members.

On the contrary, in the stack of FIG. 6, the upper casing 1 assumes a retained position with respect to the lower casing 1, the retention being made using the aforesaid mating means. Indeed, instead of assuming a same angular position, the two casings 1 have an angular position offset by 180° with respect to each other relative to the stacking central axis, which leads the male members of both casings to be respectively located on either side of the median imaginary plane P. That enables therefore the upper casing 1 to have its two male members 20 respectively cooperating with both female members 18 of the lower casing, as is also represented in FIG. 6*a* at the flanks 14*a*.

This stacking type is preferentially retained in the case of manual pipetting operations, with a sampling pipette. That enables the operator to move the stack of casings 1 without the risk of incidentally unsecuring them from each other.

Figure 7A:
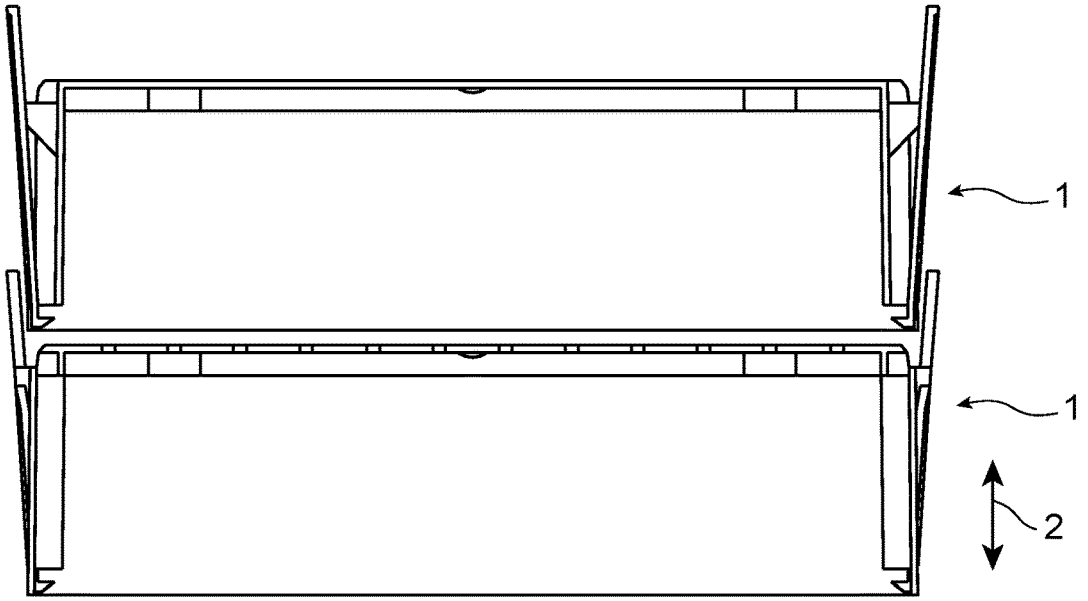
FIGS. 7*a* to 7*c* illustrate different steps of assembling the casings of the stack shown in FIGS. 6 and 6*a;*
Figure 7B:
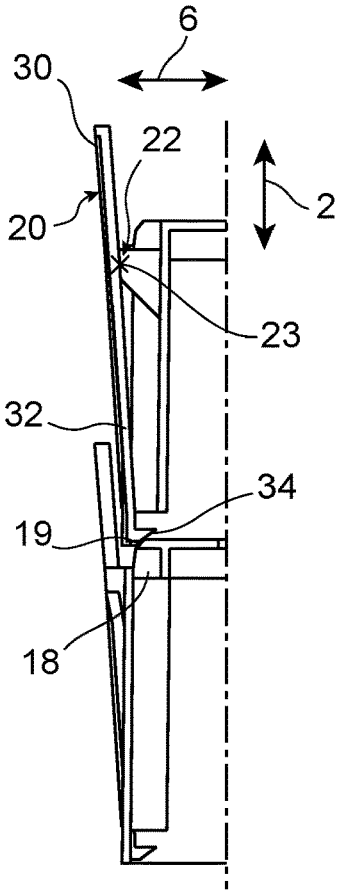
Figure 7C:
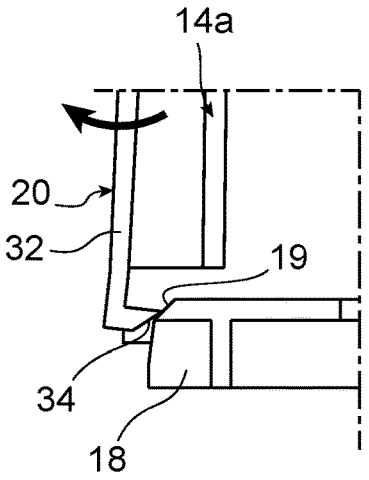

FIGS. 7*a* to 7*c* illustrate a way of automatically assembling two casings 1 to each other, simply by moving one towards the other along the stacking direction 2. They are first aligned along the direction 2 as shown in FIG. 7*a*, until the notch 34 abuts against the ramp 19 of the female member 18, as shown in FIG. 7*b*. The continuation of the relative movement, made for example by a simple downward pressure onto the upper casing, leads the notch 34 to be moved along the ramp 19 therefor. The purpose of this ramp 19 is to move away outwardly the anchoring portion 32, along the direction 6, as has been illustrated in FIG. 7*c*. That is possible by virtue of the pivoting of the tab 20 about the joint 22, along the pivoting axis 23.

When the anchoring portion 32 is moved away, both beads of material forming the pivot joint 22 are elastically torsionally deformed along the axis 23. Hence, when the downward pressure brings the notch 34 in face of the slot defined by the female member 18, at the outlet of the ramp 19, this notch 34 is automatically inserted in the female member 18 by virtue of the release of energy previously stored by the pivot joint. The retained position is thus achieved, that being also called a clipped position.

Alternatively, the mating of both casings 1 can be made by exerting a pressure onto the gripping portions 30 so as to bring them back inwardly, and then by releasing this pressure after the notches are brought in face of the female members.

Figure 8:
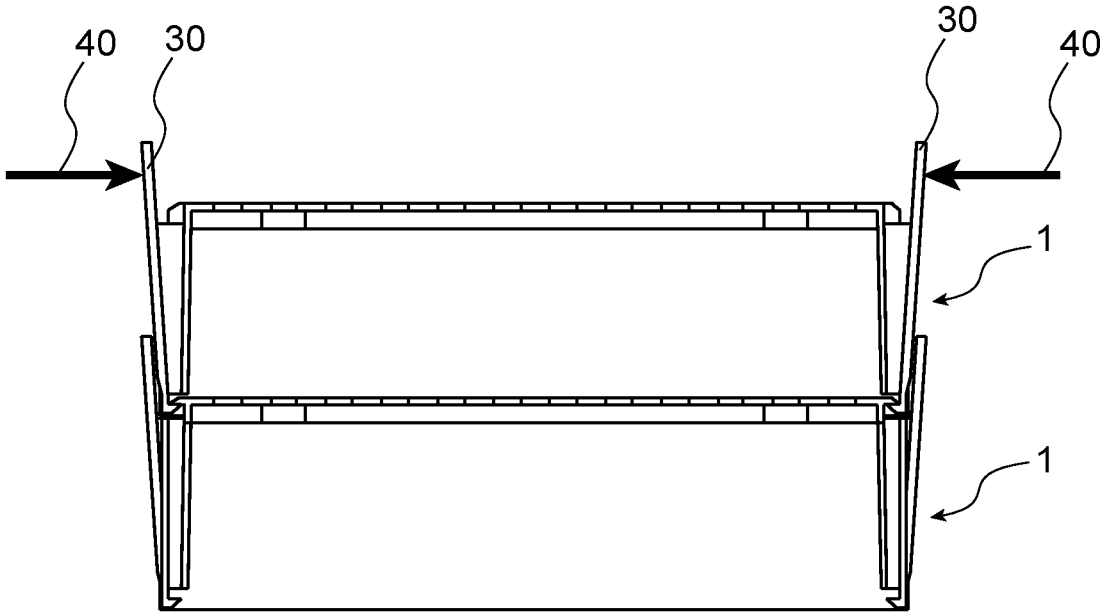
FIG. 8 illustrates a manner of a mating both casings shown in FIGS. 6, 6*a* and 7*a* to 7*c;*

For unmating both casings, a same pressure 40 depicted in FIG. 8 can be exerted onto the gripping portions 30, in order to remove the notches from the female members. Once the disengagement is made, the upper casing can be upwardly extracted, or the lower casing can be downwardly extracted, so as to make an unstacking.

Figure 9:
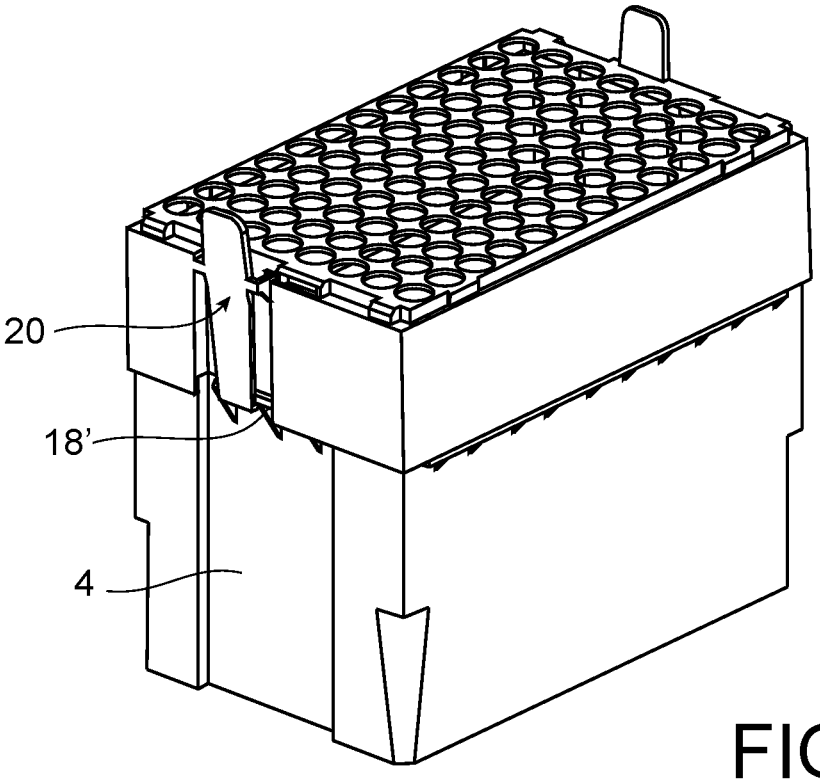
FIG. 9 is a perspective view of a hollow bottom cooperating with the casing which is the lowermost in the stack.
Figure 10:
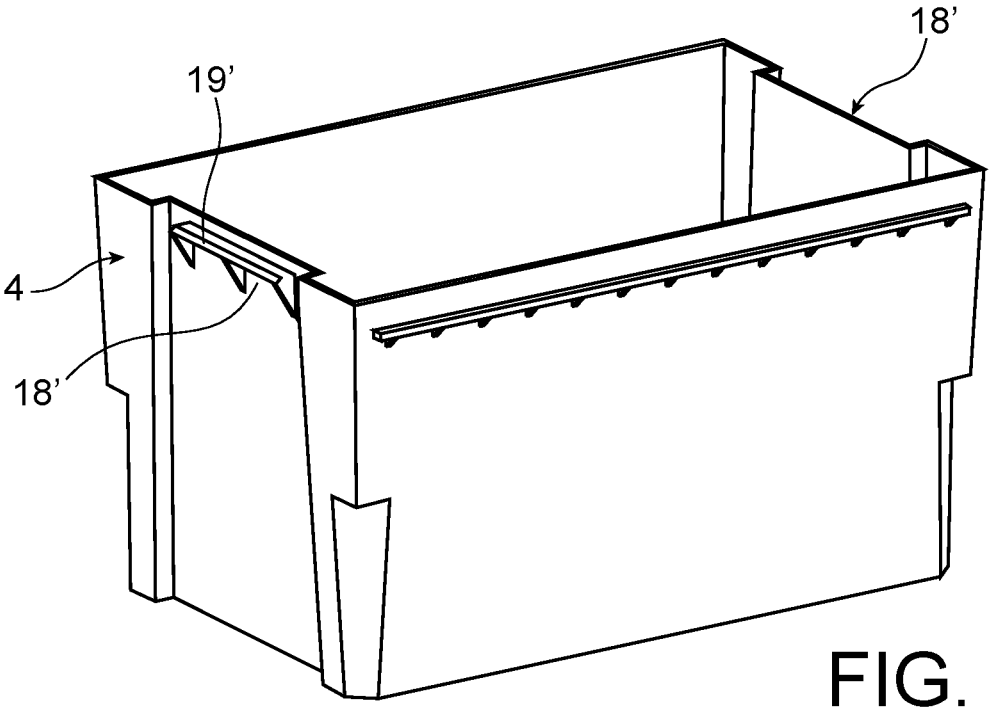
FIG. 10 is a view similar to that of FIG. 9, without the casing.
Figure 11:
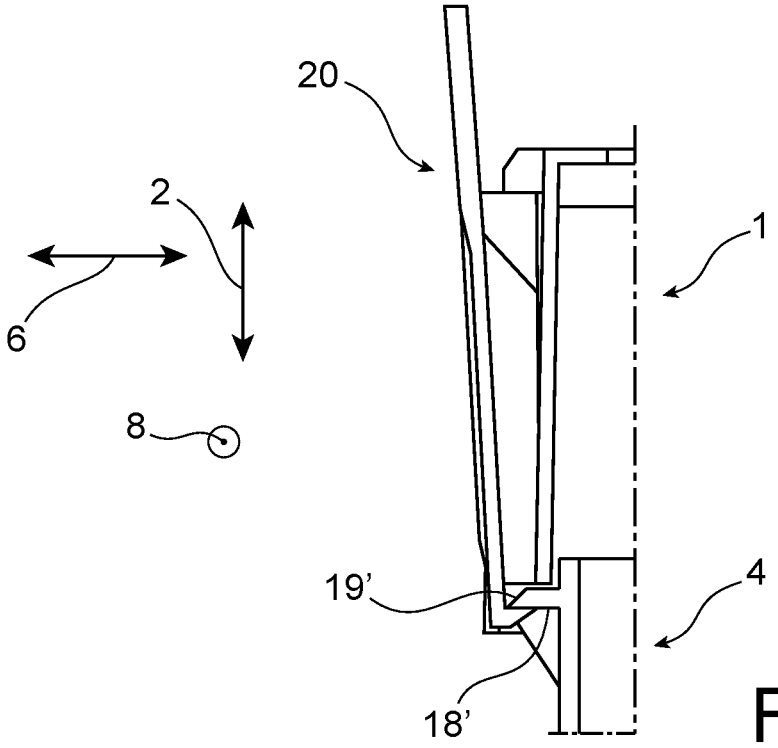
FIG. 11 is a transverse cross-section view taken on FIG. 9, and passing through the mating male member of the casing.

Finally, FIGS. 9 to 11 illustrate the fact that the upper edge of the hollow bottom 4 has mating female members 18' identical or similar to those of the casings 1, so as to be able to cooperate with the male members 20 of the casing 1 which is the lowermost in the stack. Likewise, a ramp system 19' enables the notches of the members 20 to be automatically inserted into the female members 18'.

Of course, various modifications can be made by those skilled in the art to the invention just described, only by way of non-limiting examples.

What is claimed is:

1. A casing (1) for supporting sampling cones for a pipetting system, the casing being intended to be stacked with other identical casings along a stacking direction (2), and comprising:

a support (10) provided with ports (12) for housing the sampling cones; and first and second opposite flanks (14*a*, 14*b*) integral with the support and through which a median imaginary plane (P) integrating the stacking direction (2) passes, characterised in that each of the first and second opposite flanks (14*a*, 14*b*) is equipped with a mating female member (18) as well as a mating male member (20) arranged substantially symmetrically on either side of said median imaginary plane (P), both mating female members (18) of the first and second opposite flanks (14*a*, 14*b*) being arranged on a same side of the median imaginary plane (P) and both mating male members (20) of the first and second opposite flanks being arranged on the other side of the median imaginary plane (P), and in that said mating male and female members (20, 18) are designed such that when two identical supporting casings (1) are stacked along the stacking direction (2) with an upper casing and a lower casing both having their male members (20) on a same side of the median imaginary plane (P), the upper casing (1) assumes a laid position in which it is not retained by the lower casing (1) in the stacking direction, and also designed such that when the upper casing (1) and the lower casing (1) have their mating male members (20) respectively on either side of the median imaginary plane (P), the upper casing (1) assumes a retained position in which its two mating male members (20) respectively cooperate with both mating female members (18) of the lower casing (1).

2. The casing according to claim 1, characterised in that each mating male member (20) comprises a tab pivotably mounted to its associated flank through a pivot joint (22) with an axis (23) substantially orthogonal to the stacking direction (2), the tab having on either side of the pivot joint (22) a gripping portion (30), as well as an anchoring portion (32) terminating with a notch (34).

3. The casing according to claim 2, characterised in that said pivot joint (22) is made of two elastically torsionally deformable beads of material (26), both beads of material being aligned with each other along the axis (23) of the pivot joint.

4. The casing according to claim 2 characterised in that the gripping portion (30) upwardly projects beyond its associated flank (14*a*, 14*b*), and in that said notch (34) is arranged substantially at a bottom end of this flank.

5. The casing according to claim 2, characterised in that the female member (18) has in an upper part thereof a ramp (19) enabling, during a relative movement of the upper casing towards the lower casing in the stacking direction (2), its associated male member (20) to be pivoted about said pivot joint (22) by moving the notch (34) along the ramp (19), before the notch (34) is automatically inserted in the female member (18) after this notch has left said ramp.

6. The casing according to claim 5, characterised in that said automatic insertion of the notch (34) in the mating female member (18) is made by pivoting the mating male member (20) caused by a release of energy previously stored by the pivot joint (22), during the movement of the notch (34) along the ramp (19).

7. The casing according to claim 1, characterised in that each mating female member (18) is arranged substantially at a top end of its associated flank, in the proximity of a junction with the support (10) of sampling cones.

8. The casing according to claim 1, characterised in that the support has 96 ports (12) for housing the sampling cones.

9. An assembly (100) comprising several identical casings (1) according to claim 1, said casings (1) being stacked along the stacking direction (2), in the laid position or in the retained position.

10. The assembly according to claim 9, characterised in that it includes a hollow bottom (4) arranged at the base of the stack of casings, said hollow bottom (4) comprising female members (18') for mating with the casing (1) which is the lowermost in the stack.

* * * * *